United States Patent [19]

Fetherston

[11] 3,999,346

[45] Dec. 28, 1976

[54] SNAP INTERLOCK DECK STRUCTURE

[75] Inventor: George C. Fetherston, Weston, Conn.

[73] Assignee: Burnham Corporation, Irvington-on-Hudson, N.Y.

[22] Filed: June 29, 1973

[21] Appl. No.: 375,178

[52] U.S. Cl. ..... 52/494; 52/482; 52/669

[51] Int. Cl.[2] ..... E04B 5/52

[58] Field of Search ..... 52/588, 492, 668, 669, 52/758.14, 522, 483, 664, 684, 494, 482

[56] References Cited

UNITED STATES PATENTS

| | | | |
|---|---|---|---|
| 3,528,391 | 9/1970 | Johnson | 52/588 X |
| 3,548,556 | 12/1970 | Vermeulen | 52/492 |
| 3,716,027 | 2/1973 | Vickstrom et al. | 52/669 X |

FOREIGN PATENTS OR APPLICATIONS

| | | | |
|---|---|---|---|
| 723,839 | 12/1965 | Canada | 52/483 |

*Primary Examiner*—Price C. Faw, Jr.
*Assistant Examiner*—Carl D. Friedman
*Attorney, Agent, or Firm*—Haynes N. Johnson

[57] ABSTRACT

An aluminum deck structure, of the general type in which floor joists support and are secured to transverse decking members, is characterized by an assembly arrangement permitting rapid and inexpensive installation of decking members on floor joists without tools or fasteners, and allowing considerable thermal elongation and contraction of long decking members such as are used in platform tennis courts or other playing surfaces. In the deck structure, extruded aluminum decking members are formed with a floor plate and two depending vertical legs having bearing flanges and horizontally opposed latching members at their lower ends. Extruded aluminum floor joists have longitudinal ribs along their top supporting surfaces with pairs of notches in the ribs to receive the vertical legs of a decking member. The notches form opposed latching surfaces which meet and then snap into interlocking engagement with the latching members on the vertical legs as the legs descend into the notches. Installation of decking is accomplished simply by placing it in position upon the floor joists and applying a downward force, as by stepping on it. The notches act as guideways to lengthwise movement of decking members and thus allow movement resulting from thermal elongation and contraction.

5 Claims, 5 Drawing Figures

42
40
5
48L
50L
60L
70L
44
48R
50R
60R
70R
30
32L
32R
24
28
26
22
20

42
40
5
48L
50L
30
24
28
26
22
20

SNAP INTERLOCK DECK STRUCTURE

BACKGROUND OF THE INVENTION

1. Field of the Invention

This invention relates to metal deck, platform, or surface structures of the general type in which joists support and are fastened to transverse decking members or planks. The present invention particularly relates to an aluminum deck structure adapted for recreational purposes, such as the formation of a playing surface for a platform tennis court.

2. Description of the Prior Art

Metal deck structures typically assemble decking members and joists with conventional fasteners such as bolts or welds. These assembly techniques, which necessarily occur in the field, require a great deal of time and labor, sometimes require advance preparation and dangerous equipment, and ultimately are very expensive. Moreover, where long decking members susceptible to thermal elongation must be used, as in the construction of a platform tennis court, these fastening techniques are placed under great stress and the fasteners sometimes break or cause distortion of the deck structure.

SUMMARY OF THE INVENTION

It is a principal object of the present invention to provide an improved deck structure, of the type using joists and decking members, which may be assembled without the use of expensive labor for either welding or bolting the decking in place. It is a further object of the invention to provide a deck structure capable of allowing substantial thermal elongation and contraction of decking members.

In a preferred embodiment of the invention to be described hereinbelow in detail, the deck structure is characterized by decking members extruded for example from aluminum and formed with a floor plate and two depending vertical legs with horizontally opposed latching members at their lower ends. The transverse floor joists, also extruded for example from aluminum, are formed with a vertical rib along the top supporting surface. The rib is provided with openings or notches adapted to receive the vertical legs of a decking member. The notches form opposed latching surfaces which meet and then snap into interlocking engagement with the latching members on the vertical legs as the legs are urged into the notches. Assembly of decking to floor joists may be accomplished by positioning the decking and then applying a downward force, as by stepping on it, to cause the legs to flex inwardly and then snap outwardly to bring the latching members into engagement with the mating latching surfaces on the ribs.

In another aspect of the invention, the latching members and the vertical legs extend uniformly along the decking members, and the openings or notches in the ribs act as transverse guideways to the vertical legs and latching members to allow lengthwise movement of the decking members and thus accommodate thermal elongation and contraction.

Other objects, aspects and advantages of the invention will be pointed out in, or apparent from, the detailed description hereinbelow, considered together with the following drawings.

DESCRIPTION OF THE PREFERRED EMBODIMENT

Figure 1:
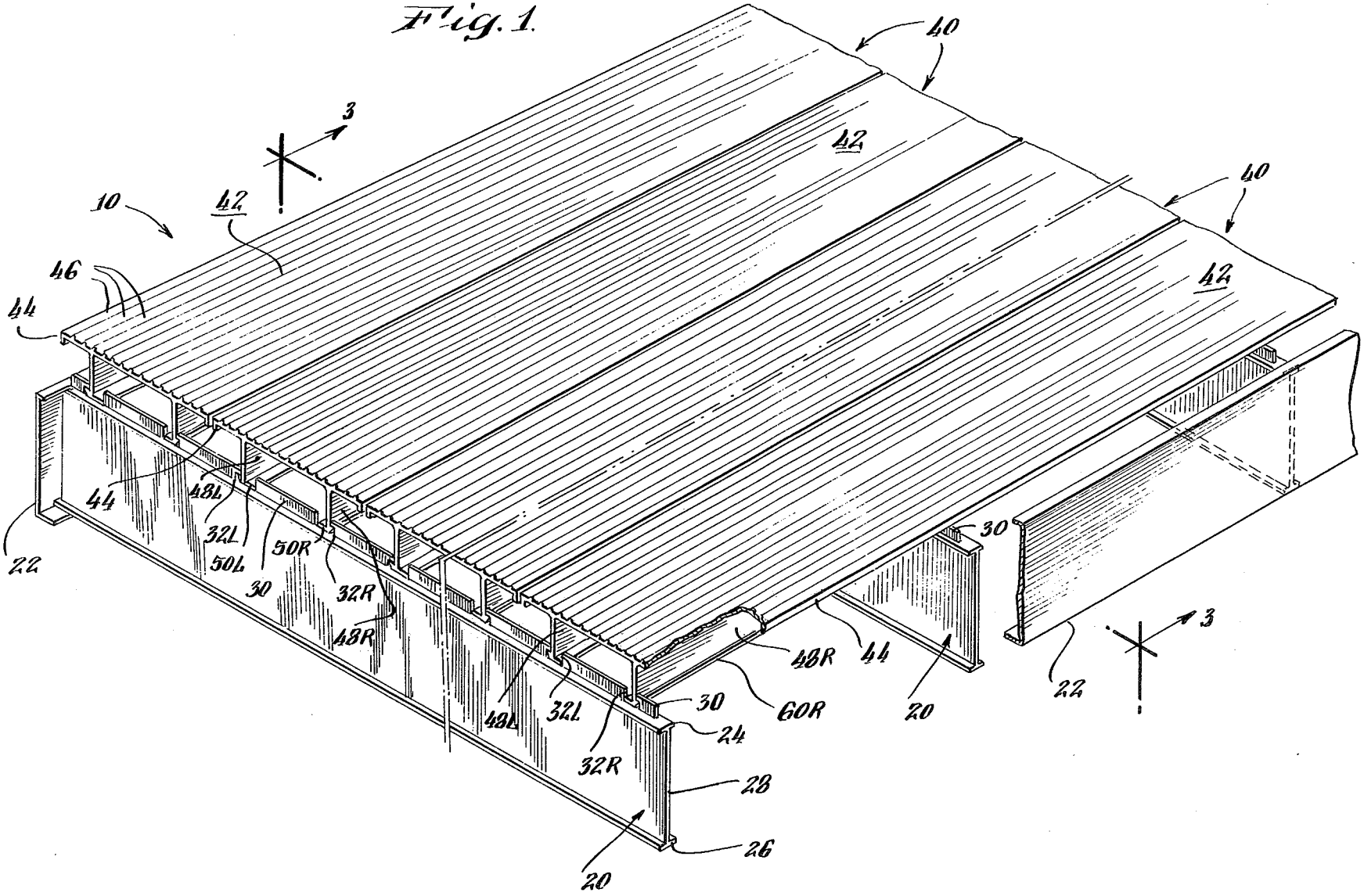
FIG. 1 is a perspective view, with portions broken away and in section, of a deck structure according to the present invention.
Figure 2:
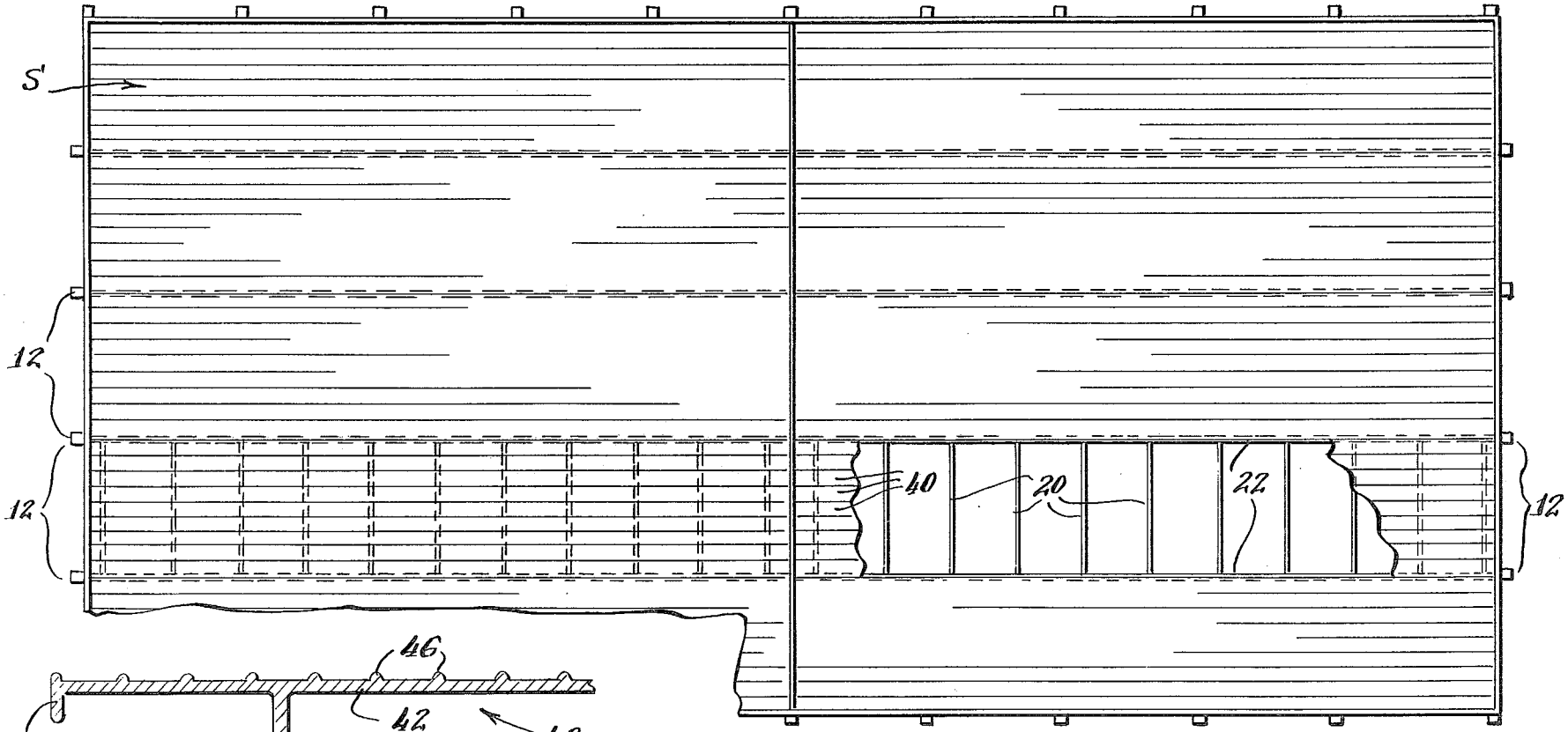
FIG. 2 is a plan view of the playing surface of a platform tennis court constructed with the deck structure of the present invention.

FIG. 1 illustrates a deck structure 10 constructed in accordance with the present invention and arranged to form one of 10 surface sections 12 making up the playing surface S of a platform tennis court (FIG. 2). As shown in FIG. 1, the deck structure 10 includes parallel floor joists 20 supported, for example, at their ends by channels 22. The floor joists 20 are typically of extruded aluminum I-beam construction having top and bottom flanges 24 and 26 joined by a central web 28.

Extending upwardly from top flange 24, in alignment with web 28, each floor joist 20 has a vertical rib 30 containing pairs of openings or notches 32L and 32R formed as described below. Preferably, rib 30 is extruded along with the remainder of joist 20, and notches 32L and 32R are formed in rib 30 with a press brake. In the embodiment illustrated in the drawings, rib 30 has a thickness of ⅛ inch and a height of ½ inch.

The floor joists 20 connect to and support an array of transverse decking members 40 which together form the deck surface S. Each decking member 40, typically made of extruded aluminum, carries a floor plate 42 with vertical depending strengthening flanges 44 at its edges. The floor plate 42, if desired, may contain nonskid ribs 46 on the upper surface for traction.

Two vertical legs 48L and 48R depend from floor plate 42 and terminate in inwardly extending supporting flanges 50L and 50R which rest in rib notches 32L and 32R upon top flange 24 of floor joist 20 to provide vertical support for the decking members 40.

Figure 3:
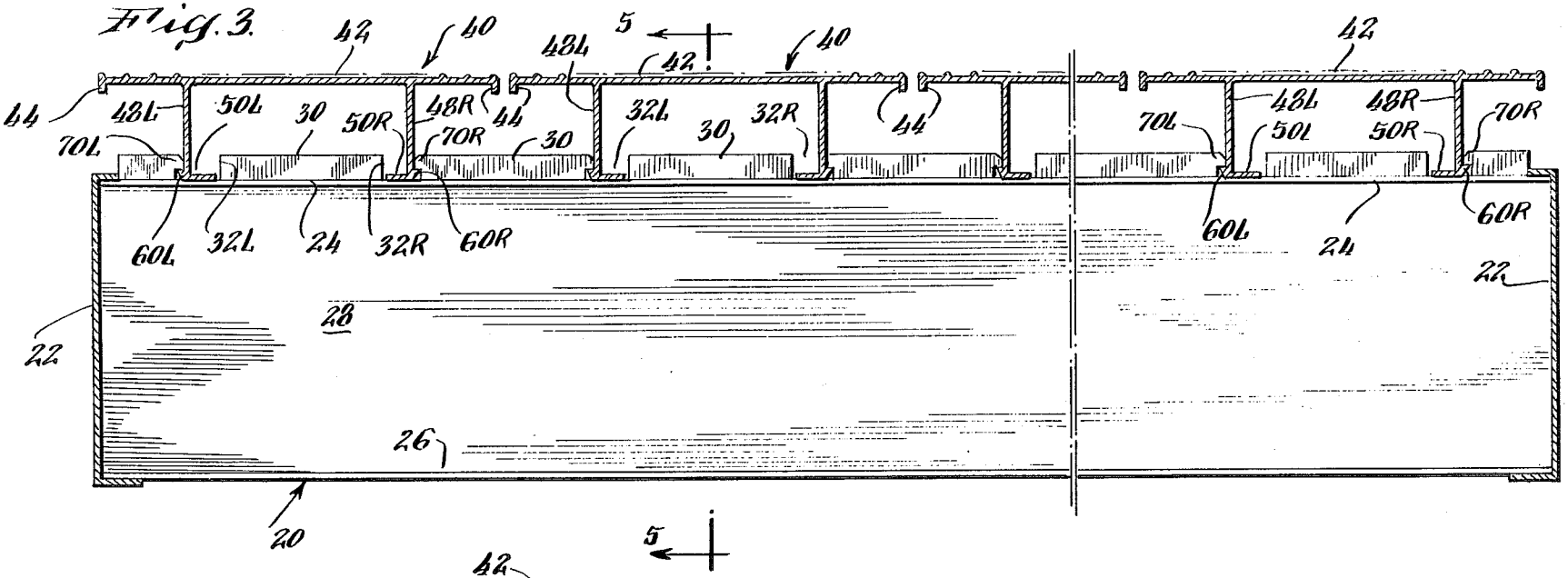
FIG. 3 is a section on line 3—3 of FIG. 1.
Figure 5:
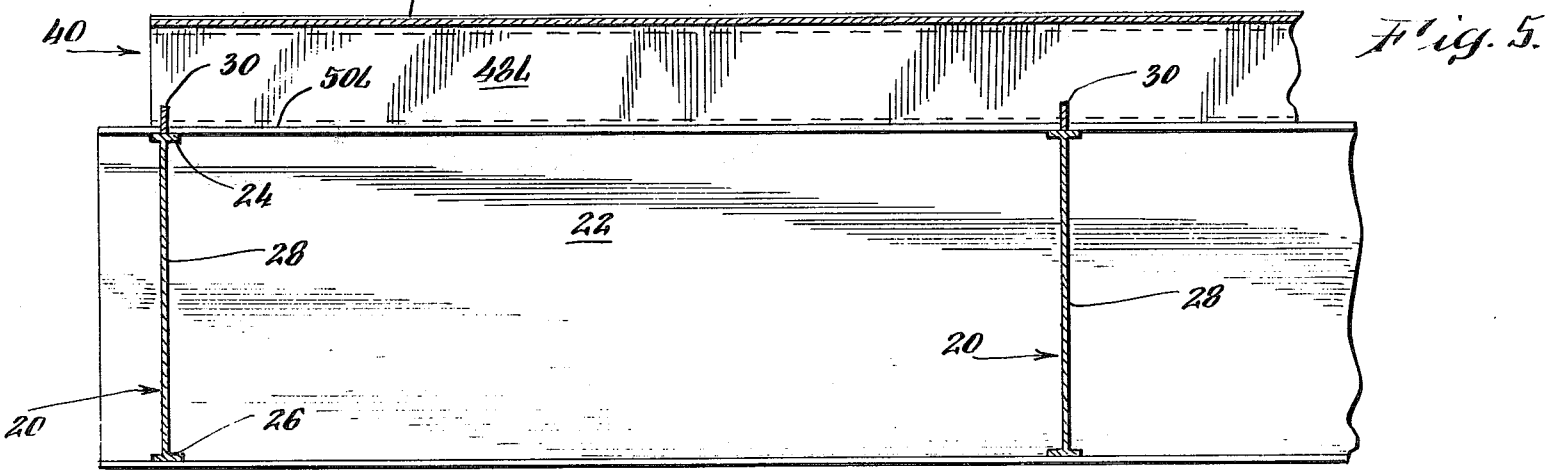
FIG. 5 is a section on line 5—5 of FIG. 3.

As indicated above, the existing welding or bolting techniques for assembling decking members to floor joists are time consuming and expensive. In accordance with the present invention, however, assembly is rapid and economical because the decking members 40 interlock with floor joists 20 by means of horizontally opposed latching members 60L and 60R located at the lower ends of vertical legs 48L and 48R and arranged to snap into engagement with corresponding horizontally opposed latching members 70L and 70R formed in notches 32L and 32R of the floor joists 20. (See FIGS. 3 and 4.)

Figure 4:
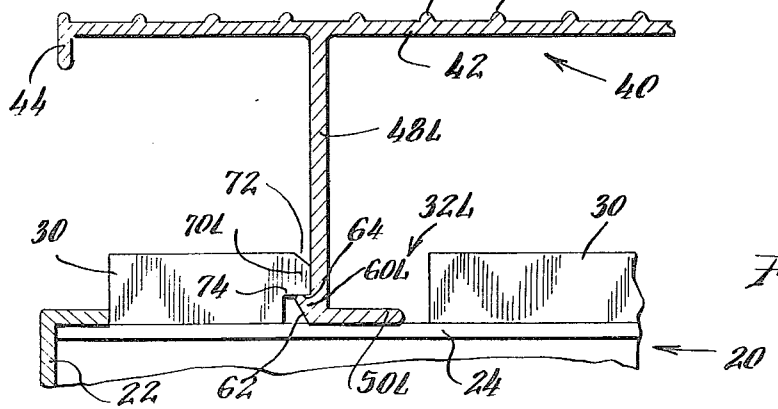
FIG. 4 is a detailed section similar to FIG. 3 but drawn with enlarged scale.

As shown for example in FIG. 4, the decking latching members 60L and 60R are in the form of outwardly extending barbs with a lower inclined surface 62 ending in an upper latching surface 64. The joist latching members 70L and 70R are in the form of inwardly extending barbs with an upper inclined surface 72 and a lower latching surface 74.

Assembly of decking members 40 and floor joists 20 is done simply by positioning decking members 40 with vertical legs 48L and 48R at the tops of notches 32L and 32R. In this position, the inclined surfaces 62 and 72 are in engagement. A downward force is applied to decking member 40, as by stepping on it, and the inclined surfaces 62 and 72 act as cams forcing the vertical legs 48L and 48R to flex inwardly until the inclined surfaces 62 and 72 pass one another. Further downward movement of decking member 40 brings latching surfaces 64 and 74 into alignment, allowing vertical legs 48L and 48R to snap outwardly to bring the latching surfaces 64 and 74 into engagement to interlock the decking member 40 and floor joist 20 together with supporting flanges 50L and 50R resting on joist top flange 24.

Assembly of decking members 40 and floor joists 20 in the manner described takes place quickly and reliably. If desired, a decking member 40 can be removed by flexing legs 48L and 48R together until latching surfaces 64 and 74 disengage, and then by raising the disengaged decking member free from the floor joist.

Decking members 40 preferably are extruded and thus have a uniform cross-section throughout their lengths. Rib notches 32L and 32R thus can engage a deck member 40 anywhere throughout its length, and joist spacing may be arranged arbitrarily.

As illustrated in FIG. 2, it frequently is necessary to utilize long decking members 40. For a platform tennis court, for example, the decking members in each deck section 12 are half the length of the court, or 30 ½ feet long. In the example shown, eleven floor joists 20 are used to support this length of decking member. The floor joists are attached to other structural members and are essentially fixed in place. Metal, and particularly aluminum, has a high thermal coefficient of expansion and long decking members 40 thus are susceptible to significant thermal elongation and contraction.

In accordance with the present invention, such thermal elongation and contraction is readily accommodated because the latching members 60L, 70L and 60R, 70R interlock so as to prevent vertical and sidewise movement of decking members 40, but permit longitudinal movement of the decking members in response to thermal effects.

As illustrated for example in FIG. 4, the notches 32L and 32R act as guideways to the decking members 40, which are of uniform cross-section throughout their lengths and thus maintain vertical support through flanges 50L and 50R and interlocking engagement through latching members 60L and 60R even if moved longitudinally. Thus whereas thermal elongation can cause breakage and distortion where bolts or welds are used, the present invention offers trouble free and distortion free operation.

In the particular embodiment of the invention illustrated, the decking members 40 are symmetrical about a vertical center line and are dimensioned, approximately, to provide floor plates 42 with a width of 8 inches; strengthening flanges 44 with a width of ¼ inch; vertical legs 48L and 48R which are 4 ½ inches apart and two inches long; supporting flanges 50L and 50R with a width of ½ inch; and latching members 60L and 60R with a latching surface 64 with a width of about 1/10 inch and an inclined surface 62 of slightly more than 2/10 inches in width. Wall thickness is 0.078 inches. Notches 32L and 32R have a latching surface 74 with a width of ⅛ inches and an inclined surface 72 with a vertical height of about 1/10 inches and lying at an angle of 36 ½ degrees to the vertical.

While deck structure 10 has been described with reference to use as a playing surface, it will be apparent that the construction described is applicable to other arrangements wherein joists support transverse decking or planking members.

Although a specific embodiment of the invention has been disclosed herein in detail, it is to be understood that this is for the purpose of illustrating the invention, and should not be construed as necessarily limiting the scope of the invention, since it is apparent that many changes can be made to the disclosed structures by those skilled in the art to suit particular applications.

I claim:

1. A deck structure comprising floor joists, transverse decking members supported by the floor joists, and means for securing the decking members to the floor joists, characterized by:

a decking member formed with a horizontal floor plate, two vertical legs depending from the floor plate, and horizontally opposed latching members at the lower ends of said vertical legs; and a floor joist formed with an upper supporting flange and a longitudinal rib extending upwardly from the supporting flange and being provided with pairs of notches spaced apart to correspond to the spacing between the vertical legs of the decking members, each pair of notches being arranged to receive the vertical legs of a decking member and forming horizontally opposed latching members on the rib for meeting and interlocking with the latching latching members on the vertical legs as the vertical legs are received within said notches;

whereby securing the floor joists in position for support of the decking members also firmly locates and supports the rib latching members in position for receipt of the decking members, so that the decking members may be secured to the floor joists merely by positioning a decking member across a floor joist with its vertical legs in alignment with the notches and by forcing the decking members downwardly against the supported rib latching members to interlock the decking member and floor joist.

2. A deck structure as claimed in claim 1 wherein the decking members are provided with supporting flanges located at the lower ends of the vertical legs and arranged to rest upon the supporting flanges of the floor joists.

3. A deck structure as claimed in claim 1 wherein the latching members at the lower ends of the vertical legs each are in the form of an outwardly extending barb with a lower inclined surface and an upper latching surface, and wherein the latching members on the floor joist ribs each are in the form of an inwardly extending barb with an upper inclined surface arranged to engage the inclined surface on the vertical leg and to flex the leg inwardly as it is received in the notch, and a lower latching surface to engage the latch surface on the vertical leg once the respective inclined surfaces have passed one another to allow the vertical leg to snap outwardly.

4. A deck structure as claimed in claim 1 wherein the decking members have a uniform cross-section through their length, whereby the decking members may be secured to arbitrarily spaced floor joists.

5. In a deck structure of the type in which fixed parallel floor joists are arranged to support thereon transverse decking members susceptible to thermal elongation and contraction, the improvement which comprises:

rib means extending along the top surfaces of the joists and having spaced openings therein acting as transverse guideways;

bearing means extending uniformly along the length of the decking member for engaging the top surfaces of the joists; and means on said decking members extending uniformly throughout their lengths and having a cross-sectional shape arranged to be received in and to mate with the spaced openings on said joists to interconnect the decking members to the joists and to fix the decking members against vertical and sidewise movement while permitting the bearing means to slide freely in a lengthwise direction along the top surfaces of the joists;

whereby thermal elongation and contraction of the decking members is freely accommodated.

* * * * *